US011172742B2

(12) United States Patent
Watson

(10) Patent No.: US 11,172,742 B2
(45) Date of Patent: Nov. 16, 2021

(54) STORAGE SYSTEM FOR HUNTING EQUIPMENT AND ACCESSORIES

(71) Applicant: Christopher M. Watson, Washington, PA (US)

(72) Inventor: Christopher M. Watson, Washington, PA (US)

( * ) Notice: Subject to any disclaimer, the term of this patent is extended or adjusted under 35 U.S.C. 154(b) by 0 days.

(21) Appl. No.: 15/796,764

(22) Filed: Oct. 28, 2017

(65) Prior Publication Data

US 2018/0116355 A1 May 3, 2018

Related U.S. Application Data

(63) Continuation of application No. 14/182,636, filed on Feb. 18, 2014, now Pat. No. 9,801,444, which is a continuation of application No. 13/006,409, filed on Jan. 13, 2011, now abandoned.

(60) Provisional application No. 61/336,003, filed on Jan. 13, 2010.

(51) Int. Cl.
*A45C 11/00* (2006.01)
*F41B 5/14* (2006.01)

(52) U.S. Cl.
CPC ..... *A45C 11/00* (2013.01); *F41B 5/14* (2013.01)

(58) Field of Classification Search
CPC ..... A45C 11/00; F41B 5/14
See application file for complete search history.

(56) References Cited

U.S. PATENT DOCUMENTS

| | | | | | |
|---|---|---|---|---|---|
| 1,982,845 | A * | 12/1934 | Wagman | A45C 3/06 | 383/33 |
| 2,282,258 | A * | 5/1942 | Snyder | B65D 31/04 | 426/106 |
| 2,837,132 | A * | 6/1958 | Daust | A45C 11/20 | 150/118 |
| 3,159,253 | A * | 12/1964 | Breault | A45C 3/00 | 190/119 |
| 3,809,228 | A * | 5/1974 | Fowler | B65D 75/28 | 206/306 |
| 4,125,212 | A * | 11/1978 | Courchesne | A45C 7/0059 | 224/153 |
| 4,200,132 | A * | 4/1980 | Avery | B65D 33/16 | 383/90 |
| 4,755,064 | A * | 7/1988 | Weber | B65D 81/3897 | 383/109 |
| 5,873,504 | A * | 2/1999 | Farmer | A45C 3/00 | 150/113 |
| 6,899,460 | B2 * | 5/2005 | Turvey | B65D 33/007 | 383/33 |
| 8,302,749 | B2 * | 11/2012 | Melmon | A45F 3/04 | 150/103 |
| 8,851,289 | B2 * | 10/2014 | Shi | B65D 5/643 | 206/478 |
| 9,801,444 | B2 * | 10/2017 | Watson | A45C 11/00 | |
| 2006/0188179 | A1 * | 8/2006 | Schlipper | B65D 29/00 | 383/34 |

* cited by examiner

*Primary Examiner* — Tri M Mai
(74) *Attorney, Agent, or Firm* — RC Trademark Company

(57) ABSTRACT

A carrying case for archery equipment including at least a first airtight compartment with provisions for organizing additional items, wherein the first compartment is suited for clothing, and a second compartment configured to store a changing mat wherein the second compartment further includes at least one distinct compartment configured to store a plurality of scents and lures.

4 Claims, 17 Drawing Sheets

STORAGE SYSTEM FOR HUNTING EQUIPMENT AND ACCESSORIES

CROSS-REFERENCE TO RELATED APPLICATIONS

This application is a continuation of U.S. patent application Ser. No. 13/006,409 (filed Jan. 13, 2011) which claims the benefit of U.S. Provisional Patent Application Ser. No. 61/336,003 (filed Jan. 13, 2010). These applications are hereby incorporated by reference into this specification.

BACKGROUND OF THE INVENTION

The subject matter disclosed in this specification relates to storage systems and more particularly, to storage systems for archery equipment and accessories.

Storage systems, and particularly those configured to store archery equipment, do not have the ability to store, conveniently and in an organized fashion, equipment, clothing, gear, and related accessories in a rugged, easily maneuverable storage device. Moreover, archery equipment and gear tends to adsorb undesirable odors when exposed to human environments. Accordingly, there is a need for a rugged archery equipment storage system capable of storing arrows, camo, boots, hats, gloves, calls, releases, scents, lures, treestand equipment and tackle, for example, capable of including a changing mat, and configured to include one or more compartments to lock out odors and keep clothing scent-free.

The discussion above is merely provided for general background information and is not intended to be used as an aid in determining the scope of the claimed subject matter.

BRIEF DESCRIPTION OF THE INVENTION

Disclosed in this specification is a carrying case for scent-free storage of archery equipment including at least a first compartment suited for clothing and a second compartment configured to store a changing mat. An advantage that may be realized in the practice of some disclosed embodiments of the storage system is the ability to maintain hunting equipment in a scent-free environment. The hunting equipment does not adsorb human scents and these scents are therefore are not subsequently detected by game.

In one embodiment, a carrying case for the scent-free storage of hunting gear is provided. The carrying case comprises a first compartment with an internal extendable bag may be extended out of the first compartment. The extendable bag comprises a zipper with two pulls and a fabric sealed on at least one side with a waterproofing coating. The extendable bag is permanently joined to the first compartment only around a periphery of the zipper. Clips are provided, one set adjacent each end portion of the zipper and another set on opposite sides of the carrying case. A rigid strip is disposed proximate the zipper such that the zipper is inset from the opening of the extendable bag by the rigid strip. The carrying case is configured to secure the first compartment and its contents in a rolled up condition to provide a scent-free environment by pulling at least one of the pulls to seal the zipper at a non-terminal position of the zipper, folding the rigid strip over the zipper at least once, and securing the two sets of first clips to the two sets of second clips. A second compartment is disposed on an external surface of the carrying case and houses an extendable changing mat irremovably secured to a portion of the second compartment. The second compartment comprising a flap with one edge of the flap permanently attached to the carrying case.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which:

The present invention is disclosed with reference to the accompanying drawings, wherein:

FIG. 13A is a perspective view of a detachable field storage system while

FIG. 15 is a perspective view of the second embodiment showing the placement of the detachable field bag while

DETAILED DESCRIPTION OF THE INVENTION

Figure 1:
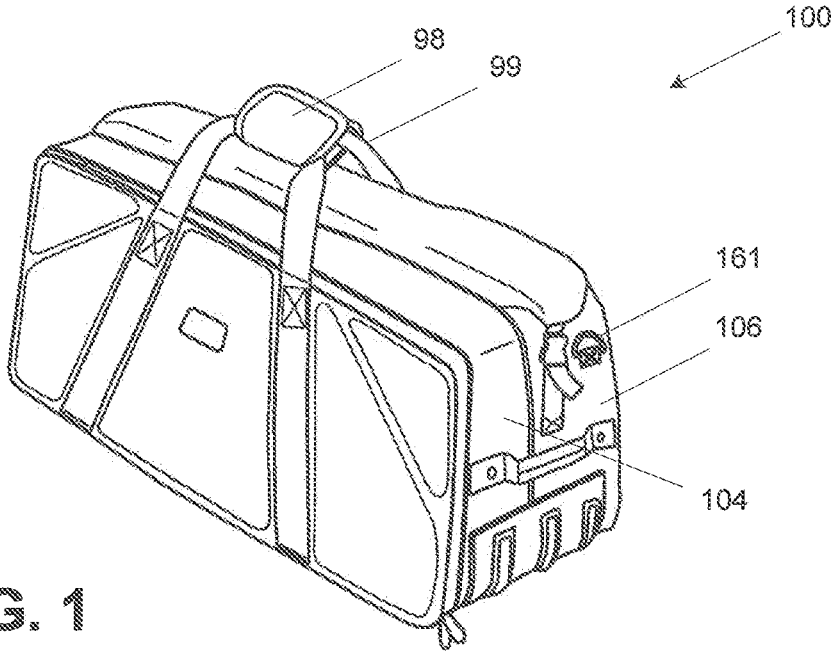
FIG. 1 is a perspective front view of a first embodiment of a storage system.
Figure 2:
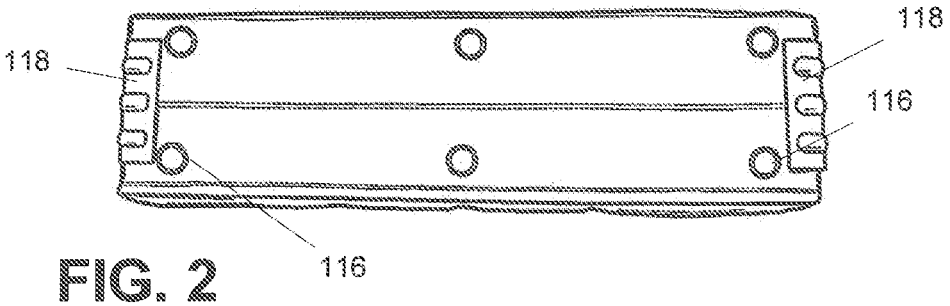
FIG. 2 is a bottom view of the first embodiment.
Figure 3:
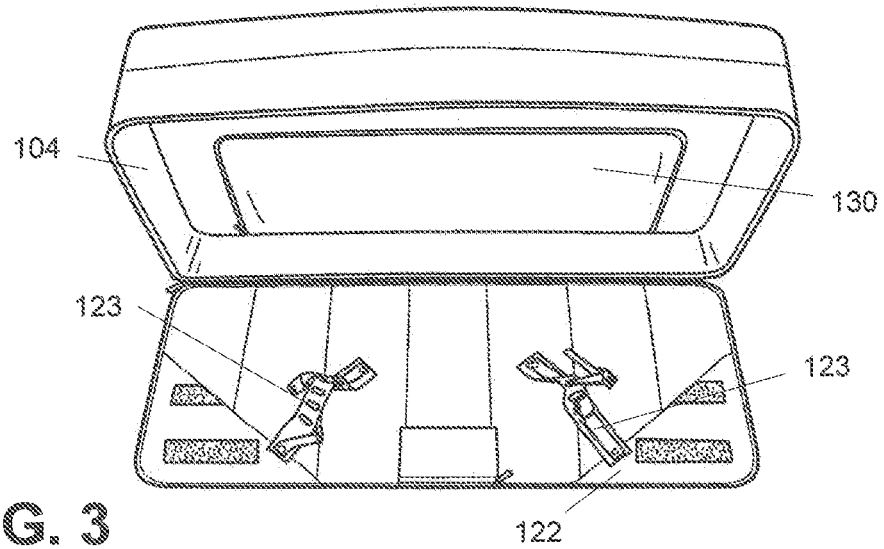
FIG. 3 is a perspective front view of the first embodiment with the storage compartment open.
Figure 4:
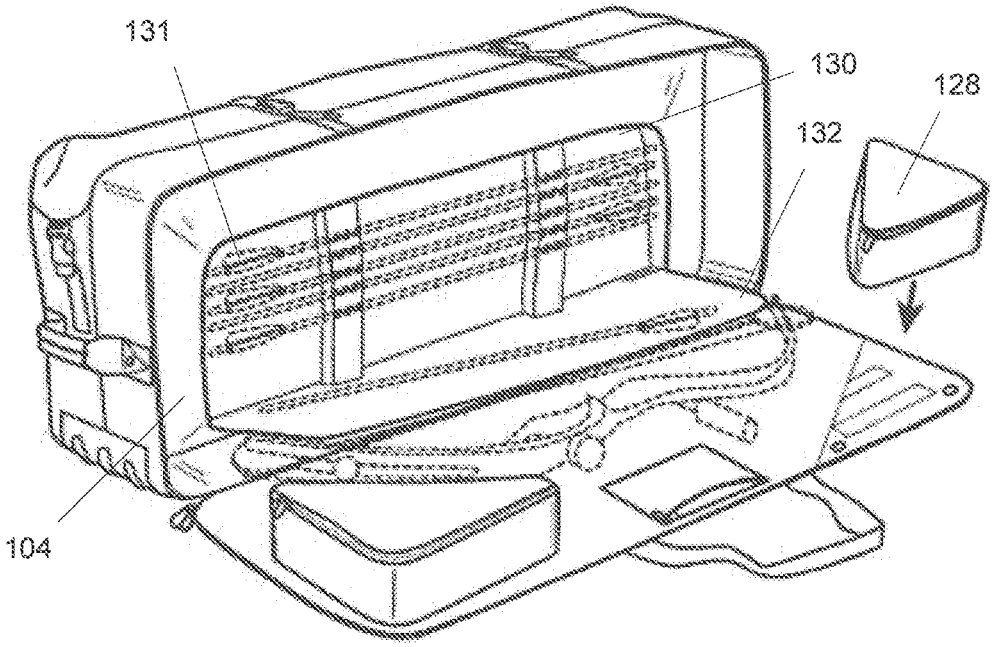
FIG. 4 is a view similar to FIG. 3 with a bow shown in phantom.
Figure 5:
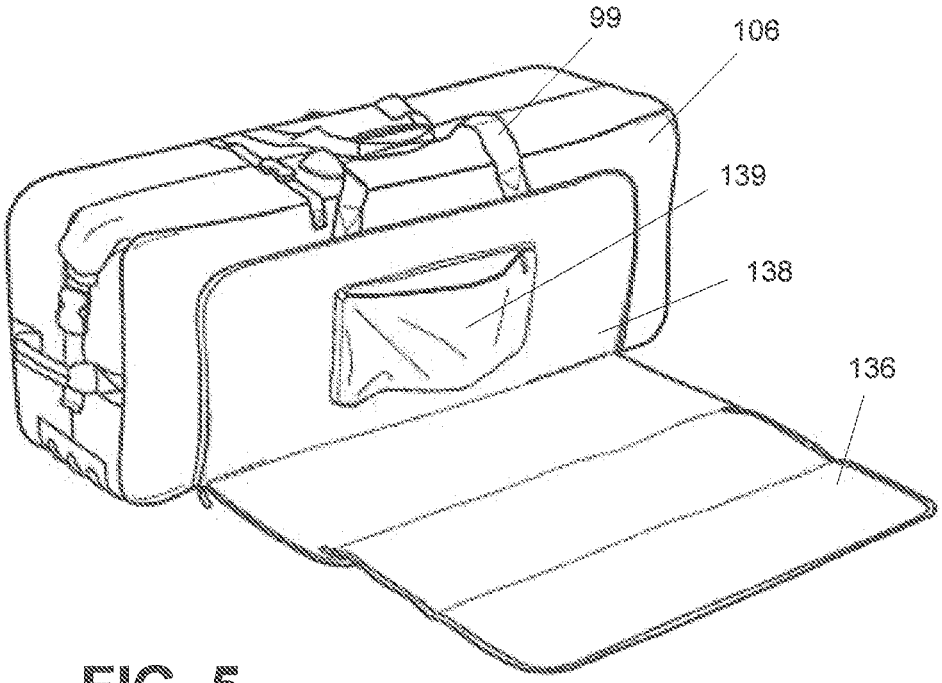
FIG. 5 is a rear perspective view of the first embodiment with a changing mat extended.
Figure 6:
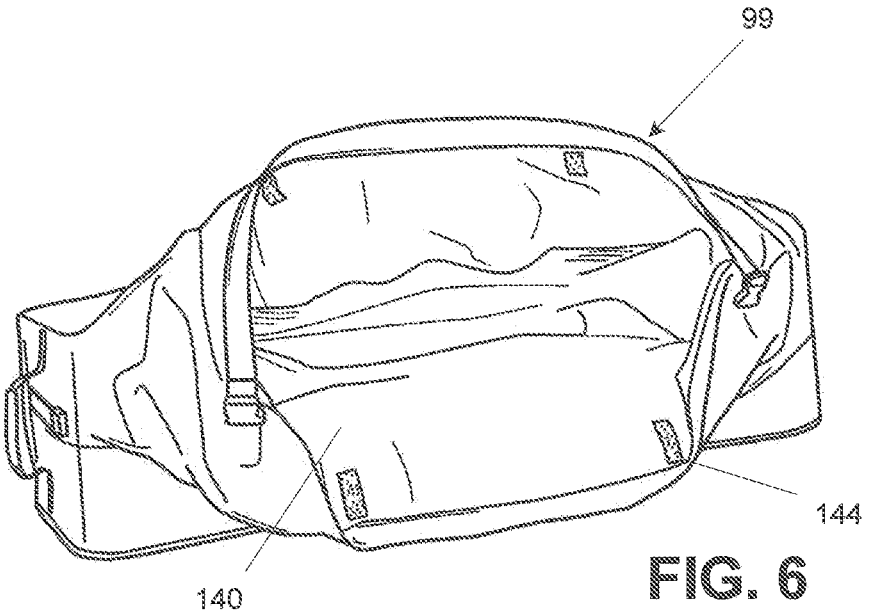
FIG. 6 is a rear view of the first embodiment with the clothing compartment open.
Figure 7:
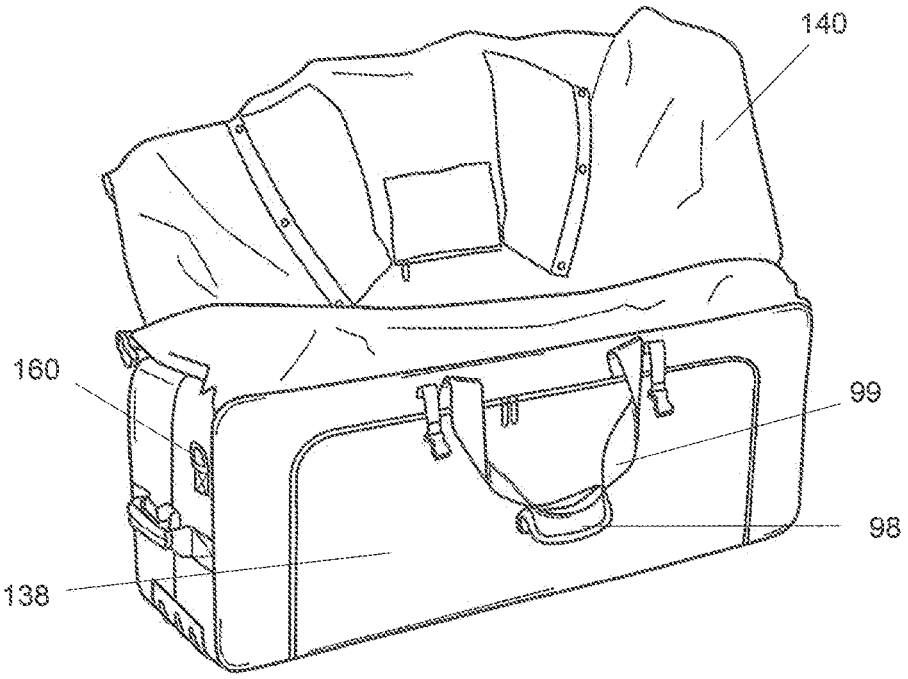
FIG. 7 is a rear view of the first embodiment with the clothing compartment lining extended.
Figure 8A:
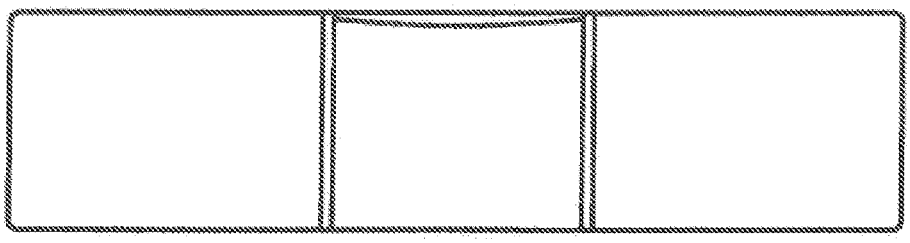
FIG. 8A-8D are schematic depictions of dividers utilized in the clothing compartment of the first embodiment.
Figure 8B:
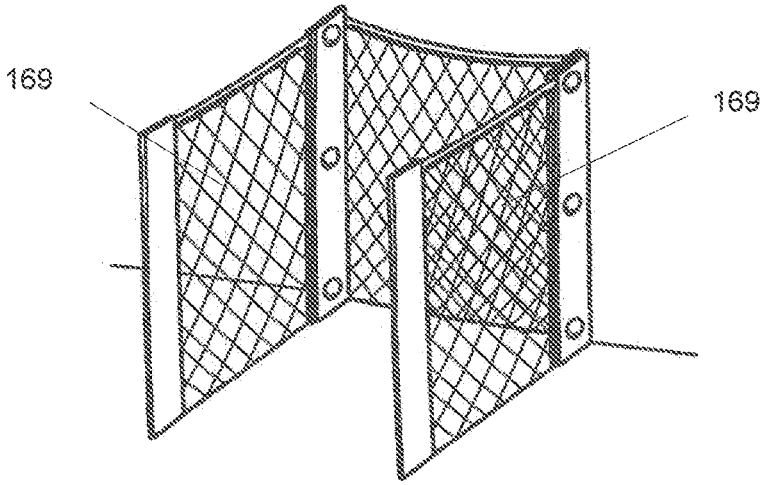
Figure 8C:
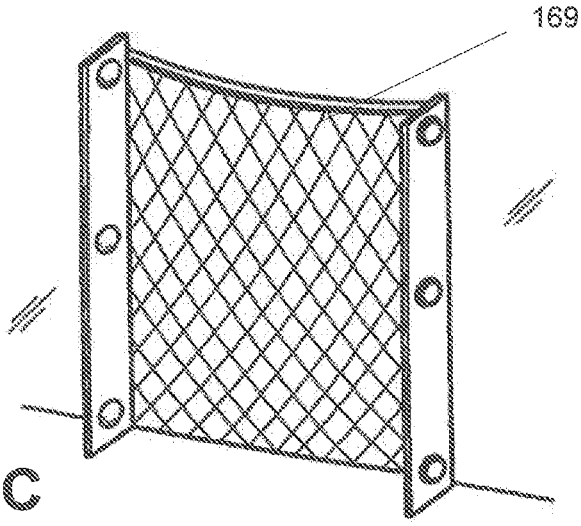
Figure 8D:
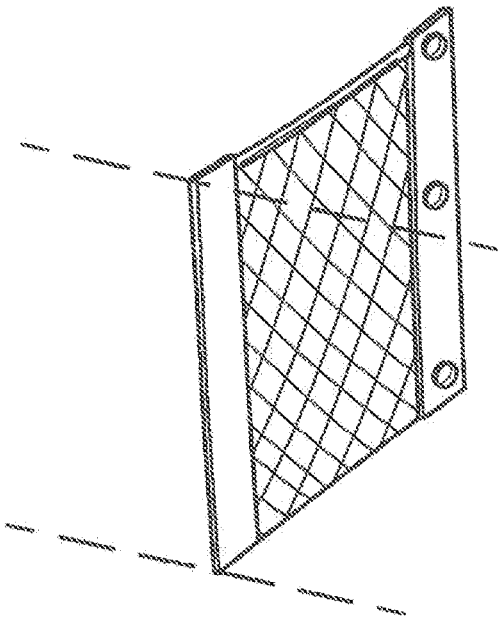

The storage systems disclosed in this specification provide a mechanism for the scent-free storage of hunting gear. A hunter's gear may become contaminated with various scents associated with humans. For example, when traveling through an airport the hunting gear may become contaminated with various human scents (e.g. perfumes, fuels, etc.). Game animals may detect these scents and avoid the hunter. The disclosed storage systems address this problem by providing a scent-free storage environment.

FIG. 1 to FIG. 8D depict a carrying case 100 for archery equipment and hunting gear. The carrying case 100 comprises a compartment 104 for archery equipment, including a bow, a compartment 130 for arrows 131, a compartment 106 for organizing additional items (e.g. clothing and the like); an external compartment 138 that houses a changing mat 136 and also houses a separate compartment 139 for the storage of hunting scents and lures.

The compartment 104 is configured to store archery equipment and includes a means to secure the bow (e.g. adjustment strap 123), a storage area for the arrows 131, and a divider 132 between the storage area for the bow and the storage area for the arrows 131. The divider 132 is defined by a flap which may be zipped shut. The compartment 104 further comprises triangular storage compartments 128 positioned near the corner areas of the compartment 104. In one embodiment, the triangular compartments are removable, being retained in their respective positions near the outer corner areas by hook-and-loop fabric and/or snaps (in one embodiment, both). The compartment 104 is on a first side of the carrying case 100 and includes a compartment closure 122 (i.e., a lid or door) manufactured of molded ethylene vinyl acetate with honeycomb and foam reinforcement and quilt stitched nylon on the internal surface. The means to secure the bow includes adjustment straps 123 to accommodate bows of varying sizes. The adjustment strap 123 may be permanently secured in position by rivets. The adjustment strap 123 is made of hypalon and the clip straps are nylon webbing. The adjustment strap 123 is secured at each end by rivets to the compartment closure and has a plurality of die-cut openings therein for receiving the adjustment straps 123 which allows for tightly securing a wide variety of commercially available bows.

The compartment 106 is configured to store hunting gear, including clothing. The compartment 106 is on a second side of the carrying case 100, the second side being opposite the first side. The compartment 106 is sealed by a zipper 144 and includes an extendable bag 140 disposed within an external shell for scent-free housing of hunting apparel. The external shell of compartment 106 is made of 840d nylon. An internal lining 140 is heat taped 210*d* nylon or the like both backed and faced with polyurethane, or the like. The outer shell functions as support, providing protection and durability while the extendable lining 140 locks out odors. The base of the extendable lining 140 is not sewn to the floor of the outer shell of compartment 106, allowing the extendable lining 140 to be lifted out for scrubbing. The extendable lining 140 has a zippered elastic mesh pocket and a non zippered inner pocket to serve for additional storage. In addition, the extendable lining 140 is colored for contrast and has snappable dividers 169 for additional organization.

The external compartment 138 stores a rollout changing mat 136 that is irremovably secured to a portion of the external compartment 138. The mat 136 is two layers of 210*d* nylon backed with polyurethane. In use, the changing mat 136 provides a place for the hunter to stand while changing clothes in the field. The external compartment 138 has a zipper closure that extends along a three-sided portion of its perimeter.

The carrying case 100 includes a detachable shoulder strap and first means 160 to clip one end of the strap to a first end of the carrying case 100 and second means 161 (see FIG. 1) to clip a second end of the strap to a second end of the carrying case 100, opposite the first end. To provide balance, the first clip is secured to the first end and the second clip to the second end. A padded portion is immovably attached (as by stitching) to the center of the strap. The length of the strap can be adjusted to accommodate the user. Carrying handles 99 stitched to each side have a gym-bag-type padded wrap 98 for comfort. Six feet 116, three spaced along each side, provide a platform for the case to rest upon when not being carried. Kick plates 118 positioned along the ends near the bottom provide protection for the case's contents.

Figure 20A:
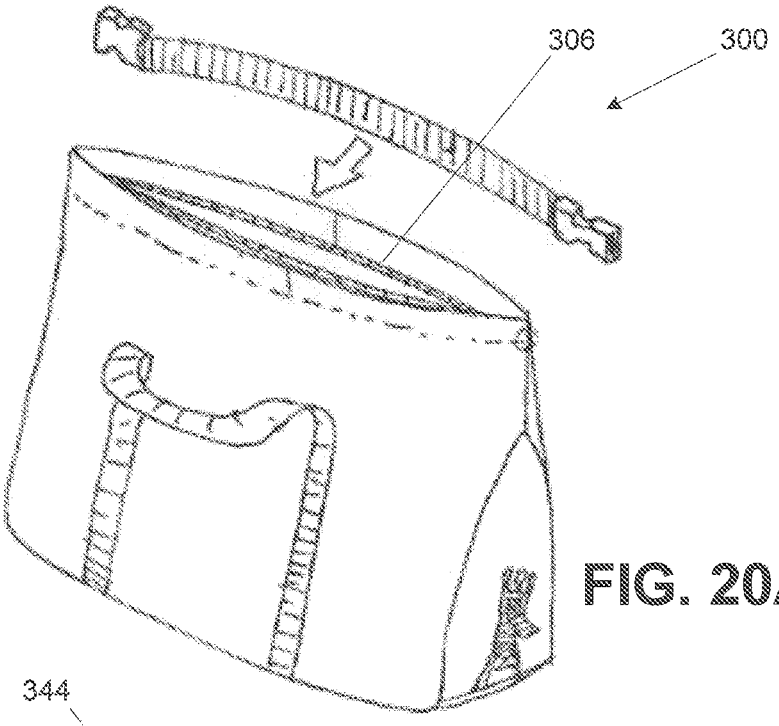
FIG. 20A and FIG. 20B are depictions of two pulls of a zipper track.
Figure 20B:
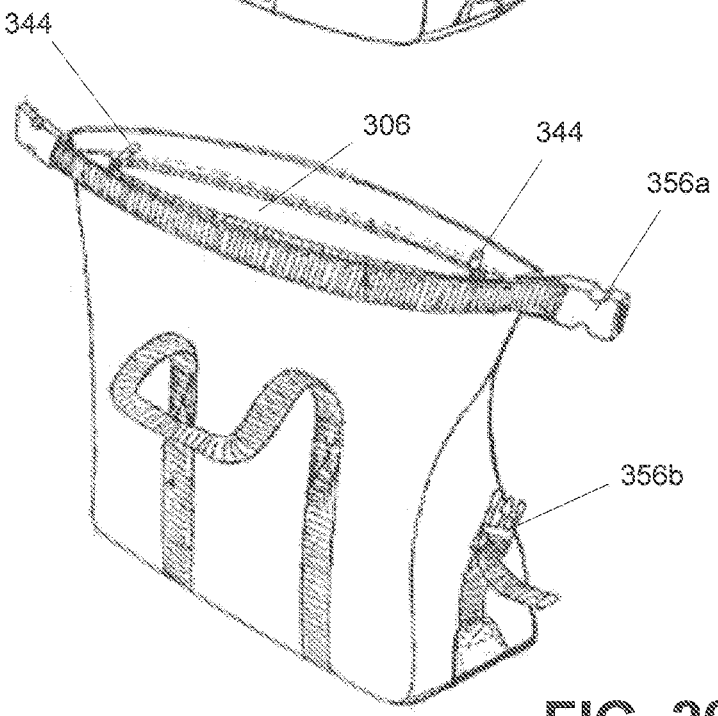

The carrying case 100 provides a scent-free environment. Specifically, the extendable bag 140 is permanently attached to the compartment 106. This permits control of the seal between the extendable bag 140 and the compartment 106 which a removable liner cannot achieve. Additionally, two pulls of a zipper track are provided that meet at a non-terminal position of the opening of the extendable bag 140 (see, for example, FIG. 20A and FIG. 20B). This configuration prevents the formation of an opening at the corners that results when only a single pull is used. When the zipper track is folded and rolled over on itself the opening between the two pulls is not located near the corner of the extendable linear and is more tightly sealed by the folding. This feature, combined with the sealed nature of the extendable linear permanently attached to an outer shell (thereby protecting the contents with two layers of material) results in the scent-free environment.

Another exemplary embodiment includes a carrying case 200 for archery equipment and hunting gear. With reference to FIG. 9 to FIG. 16, the carrying case 200 includes at least a compartment 204 for clothing, boots, and the like, a separate compartment 206 comprised of an outer shell which defines the compartment and includes an extendable lining 240 and an external compartment 238 that houses a changing mat 236. The external compartment 238 is closed with a zipper closure 238*a*. The compartment 204 is stacked below the compartment 206 and attached thereto along three sides by a zipper 245 and permanently attached thereto along a fourth side 246.

The compartment 206 is on a top side of the carrying case 200, the top side being opposite the bottom side. The compartment 206 includes, internal to its external periphery, an extendable bag with bottom and sidewalls formed from the extendable lining 240 for scent-free housing of hunting apparel. The compartment 206 is sealed with a zipper 244 with two pulls at a top end. Clips 256*a* flank the zipper 244 and, when secured to corresponding clips 256*b*, secure the compartment 206 and its contents in a rolled-up condition. The external shell is made of 840d nylon; internal lining is heat taped 210*d* nylon or the like both backed and faced with polyurethane, or the like. In one embodiment, the flexible lining 240 has a waterproof coating 240*a* on its surface. The outer shell functions as support, providing the protection and durability while the extendable lining 240 locks out odors. The base of the extendable lining 240 is not sewn to the floor of the external shell but is joined to the compartment 206 only around the periphery 201 of the compartment 206, allowing the extendable bag to be lifted out for scrubbing. The extendable lining 240 has a zippered elastic mesh pocket and a non-zippered inner pocket to serve for additional storage. In addition, the extendable lining 240 is colored for contrast and has snappable dividers 269 for additional organization. A rollout changing mat 236 is irremovably secured to a portion of the external compartment 238. The changing mat 236 comprises two layers of 210*d* nylon that is backed and faced with polyurethane.

Figure 14A:
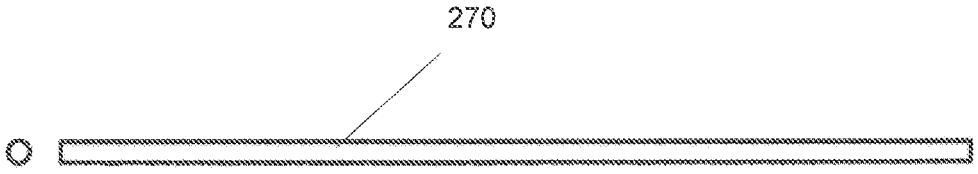
FIG. 14A and FIG. 14B depicts a pair of poles for holding the bag in an open position.
Figure 14B:
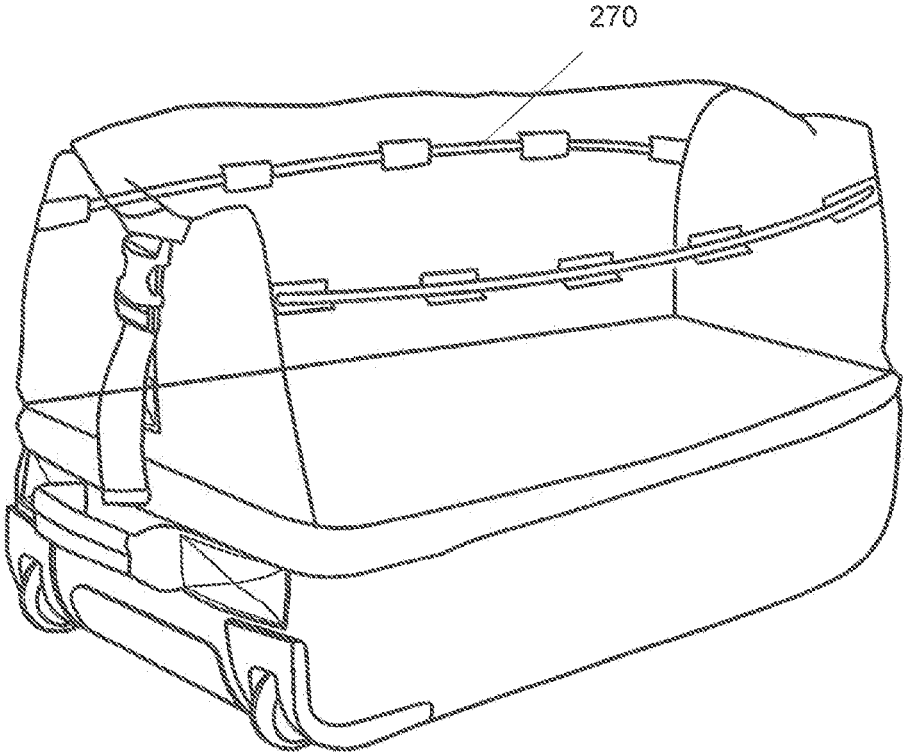
Figure 15:
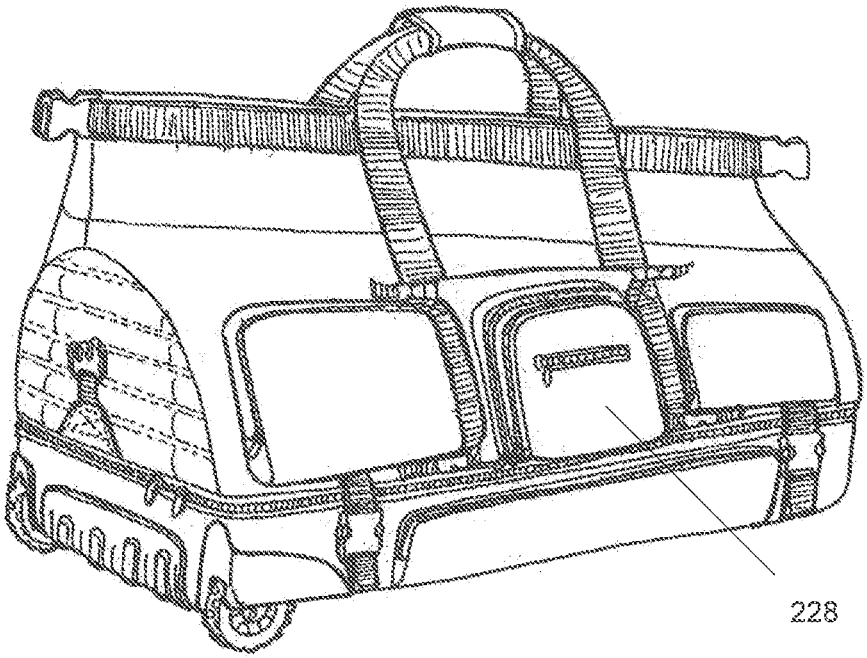
Figure 16:
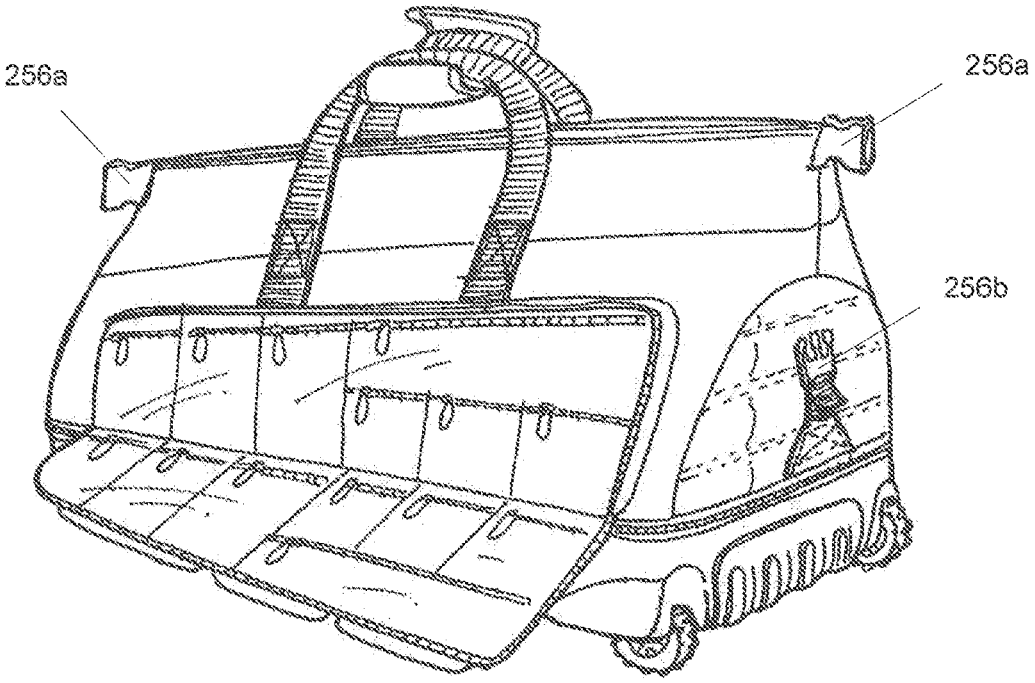
FIG. 16 shows the coupling of mating clips.

Kick plates 218 positioned along the ends near the bottom provide protection for the case's contents. Carrying handles stitched to each side have a handle wrap for comfort. Carrying case 200 also comprises wheels 219. Carrying case 200 further comprises a detachable field bag 228 removably connected to the compartment 206. In FIGS. 14A and 14B, a pair of poles 270, each on a respective side of the zipper 244 of the first compartment 204, hold the first compartment 204 in an open position.

Figure 9:
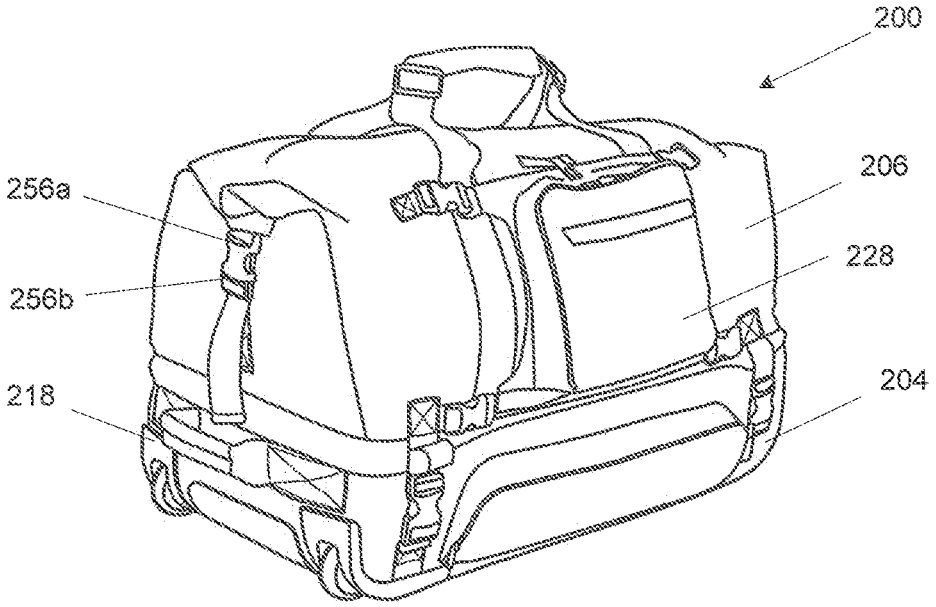
FIG. 9 is a front perspective view of a second embodiment of a storage system.
Figure 10:
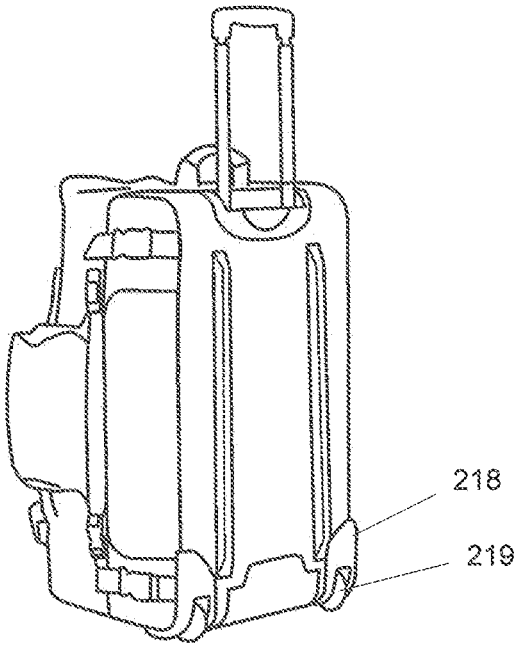
FIG. 10 is a rear perspective view of the second embodiment.
Figure 11:
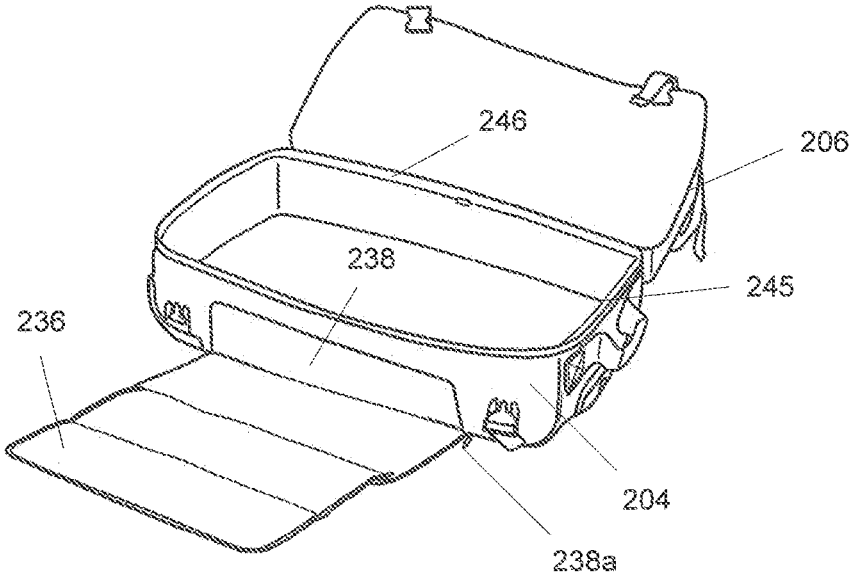
FIG. 11 is a rear perspective view of the second embodiment showing a changing mat extended.
Figure 12:
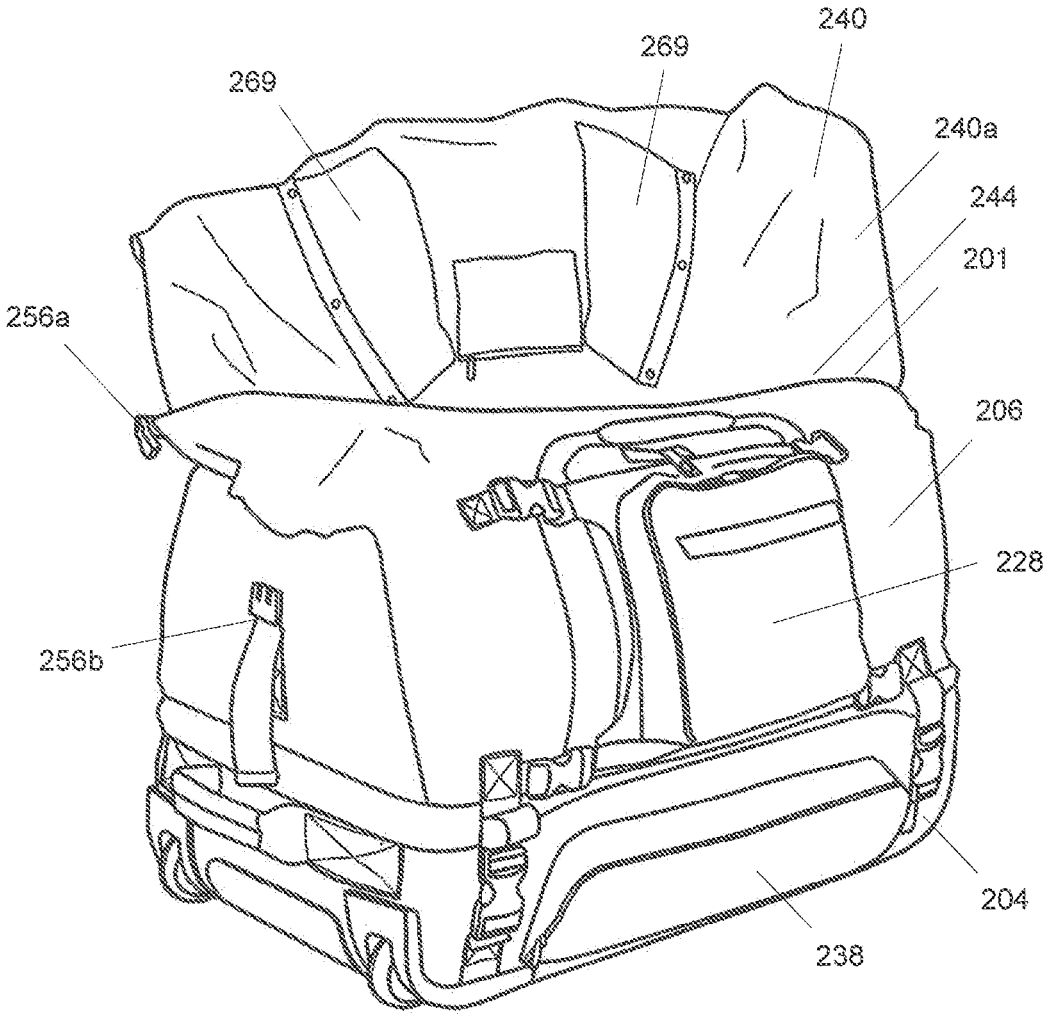
FIG. 12 is a front perspective view of the second embodiment with a clothing compartment lining extended.
Figure 13A:
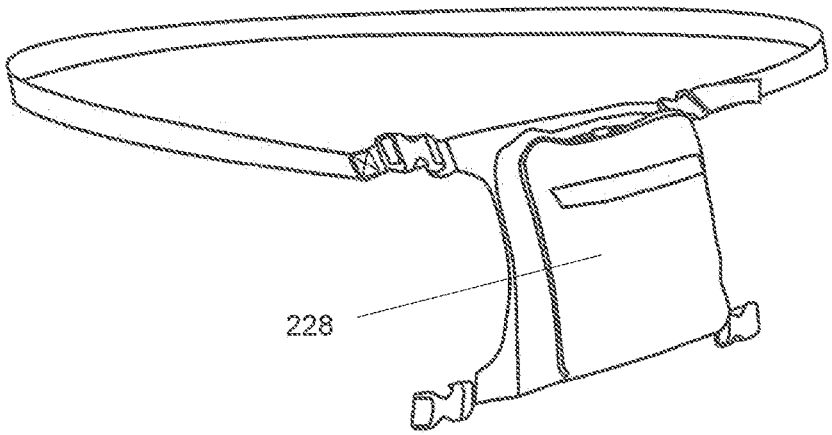
Figure 13B:
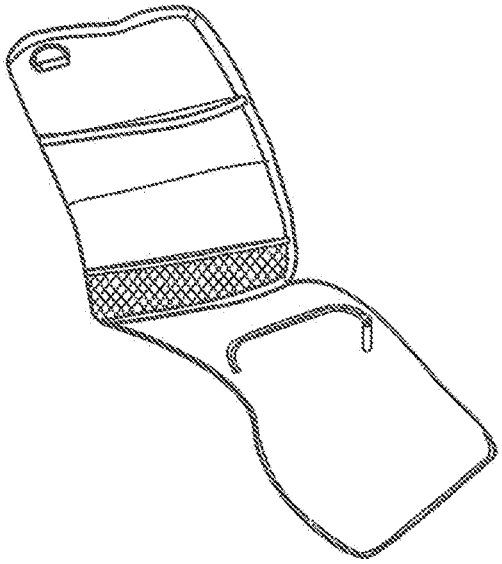
FIG. 13B depicts the bag in an opened state.
Figure 17:
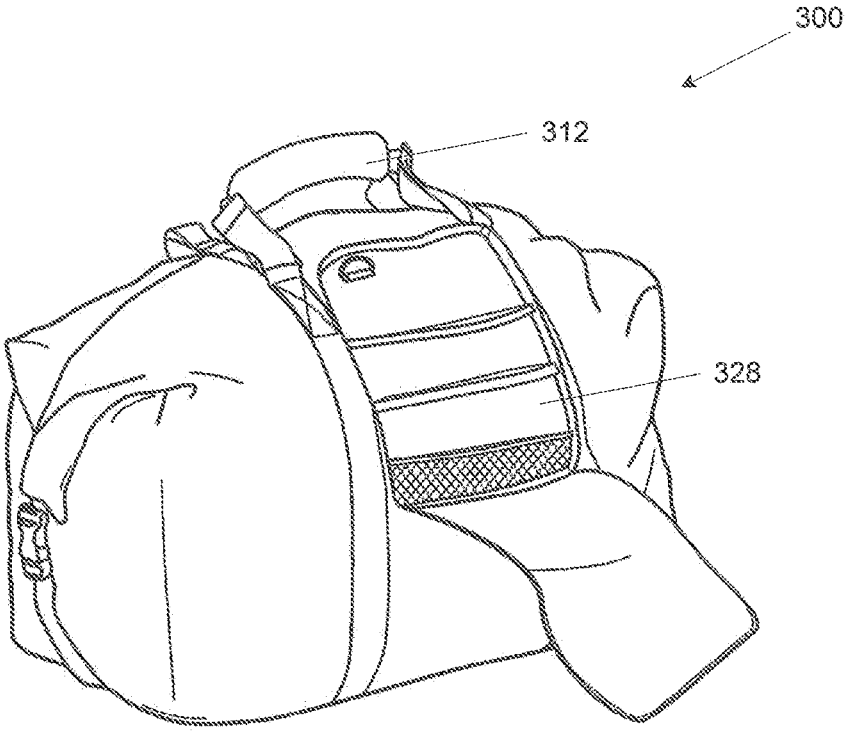
FIG. 17 is a perspective view of a third embodiment of a storage system.
Figure 19:
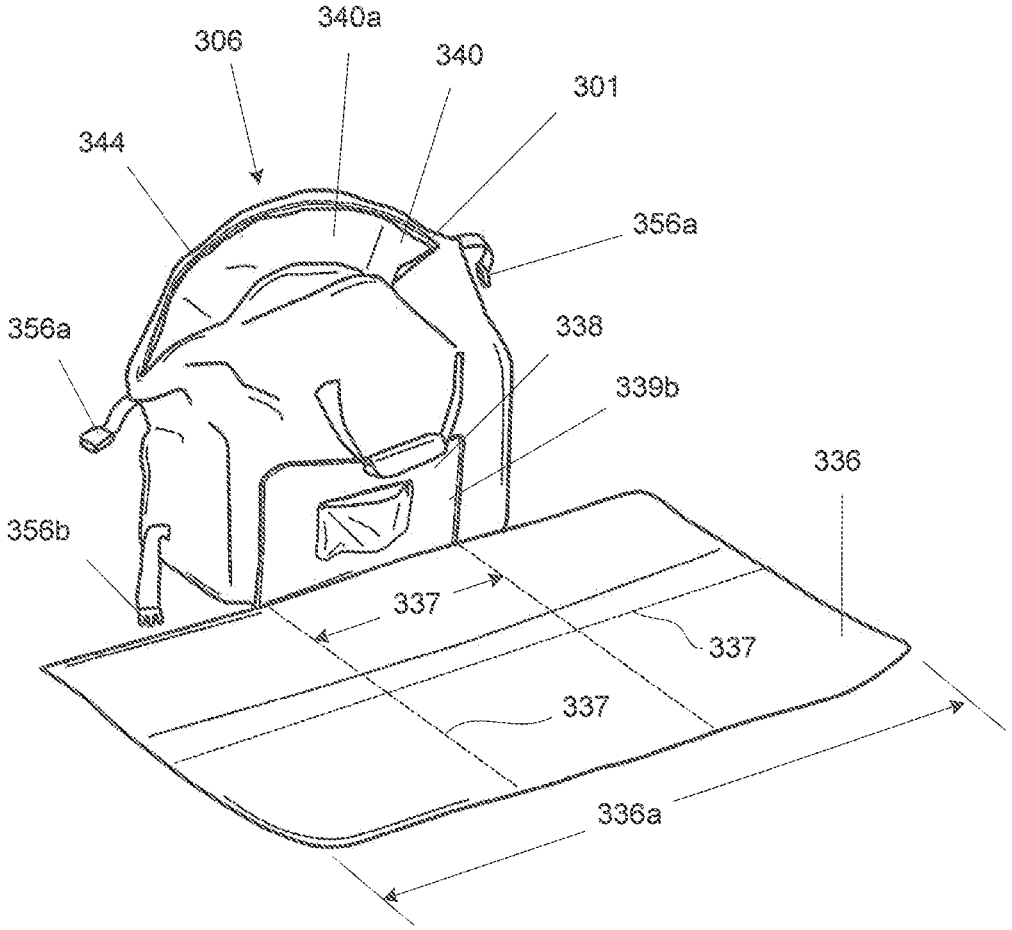
FIG. 19 illustrates the third embodiment with a changing mat extended.

As shown in FIG. 9, the first storage compartment 206 is on a top side 207 of the carrying case 200, the top side 207 being opposite the bottom side 209. As shown in FIG. 12, the first storage compartment 206 includes, internal to its external periphery, an extendable bag 240 with a bag bottom 267 and bag sidewalls 269 formed from the extendable lining 240 for scent-free housing of hunting apparel. The bag 240 defines a bag space 240*b* (FIG. 19). The compartment 206 is sealed with a zipper 244 with two pulls at a top end, edge or periphery 201 (FIG. 12) of the first storage compartment 206. Clips 256*a* flank the zipper 244 and, when secured to corresponding clips 256*b*, secure the compartment 206 and its contents in a rolled-up condition 273 (FIGS. 9, 14B and 17). The external shell is made of 840d nylon; internal lining is heat taped 210*d* nylon or the like both backed and faced with polyurethane, or the like. In one embodiment, the flexible lining 240 has a waterproof coating 240*a* on its surface. The outer shell functions as support, providing the protection and durability while the extendable lining 240 locks out odors. The base or bag bottom 267 of the extendable lining 240 is not sewn to the compartment floor 275 (FIGS. I1 and 14B) of the external shell but is joined to the first storage compartment 206 only around the edge or periphery 201 of the first storage compartment 206, allowing: (a) the extendable bag 240 to be lifted out for scrubbing; and (b) the bag bottom 267 to be moved from a first position within the first storage space 206*a* (FIG. 14B) to a second position 279 (FIG. 12) outside of the first storage space 206*a*. The extendable lining 240 has a zippered elastic mesh pocket 281 and a non-zippered inner pocket to serve for additional storage. In addition, the extendable lining 240 is colored for contrast and has snappable dividers 269 for additional organization. A rollout changing mat 236 is irremovably secured to a portion of the mat compartment or external compartment 238. The changing mat 236 comprises two layers of 210*d* nylon that is backed and faced with polyurethane. In the embodiment shown in FIG. 11, the second storage compartment 204 has a perimeter side wall 283 which includes an interior surface 285 and an exterior surface 287.

Figure 18:
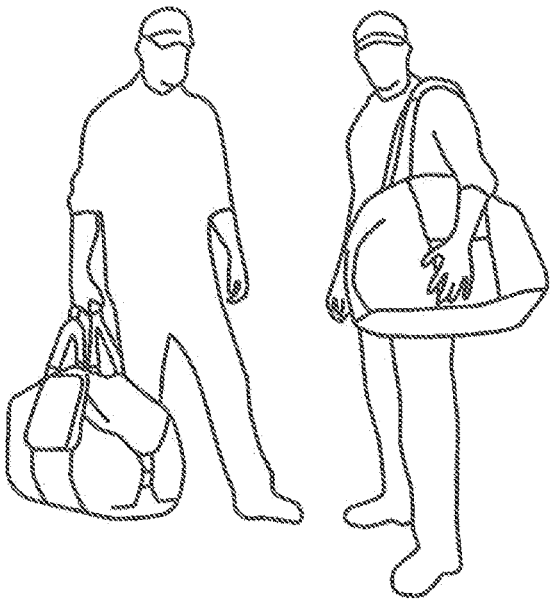
FIG. 18 illustrates the third embodiment being held by a human hand or supported by a human shoulder.

FIG. 17 is a perspective view of a third carrying case 300. With reference to FIGS. 17-19 carrying case 300 comprises an adjustable handle 312 at the top end of the bag. A compartment 306 is sealed by a zipper 344 with two pulls. See FIG. 20A and FIG. 20B. Clips 356*a* flank the zipper 344. Clips 356*a* are configured to mate with clips 356*b*. Like compartments 106 and 206, the compartment 306 is configured to have zipper 344 rotated in a rotary direction and then the fabric top is folded and rolled over on itself, overlapping and surrounding the zipper 344 to create a scent-free environment. Thereafter, clips 356*a* and 356*b* are mated which seals the compartment 306 and maintains the compartment 306 in a closed state and provides a substantially scent-free environment. The folding-closure provides control over the airflow within the compartment 306 to limit the intrusion or release of scents. A rigid strip or stiffener 293 (FIGS. 17A and 19-23) may be disposed along the edge or perimeter 2952 of the opening of compartment 306 to promote the folding. Perimeter 295*a* is located opposite of edge or perimeter 295*b* (FIG. 19). As shown in FIGS. 17A and 19, the zipper track or zipper 344 is inset such that the rigid strip or stiffener 293 is above the zipper 344 such as in the configuration illustrated in FIG. 22. Such a configuration insures the zipper 344 will be at the center of the folding-closure. The carrying case 300 may comprise one or more storage compartments 328 on its external surface. Depending on the adjusted length of the handle 312, the carrying case 300 can be carried by hand or strapped over one's shoulder. See FIG. 18.

The compartment 306, having separable edges or perimeters 295*a* 295*b*, is formed by an extendable bag 340, similar to lining 140 and 240, that attaches to the carrying case 300 at the periphery 301 of the zipper 344. When the case 300 is positioned upright in unrolled condition as shown in FIG. 19 the liner or bag 340 has side surfaces (e.g., side surface 309) that extend upward toward the zipper 344. The flexible liner or bag 340 is free floating such that the bottom of the liner or bag 340 can be inverted to pass through the opening provided by zipper 344. In one embodiment, the flexible liner or bag 340 has a waterproof coating 340*a* on its surface. Such a configuration permits the liner or bag 340 to be inverted to permit easy cleaning. Additionally, the configuration provides a second layer that promotes a sealed environment and prevents scents from leaving the compartment 306 and/or water from entering the compartment 306.

In one embodiment, the carrying case 300 comprises an extended changing mat 336 that is permanently attached to a lower edge of the carrying case 300. In FIG. 19. the extended changing mat 336 is shown in an extended state. When not in use the extended changing mat 336 can be folded along fold lines 337 and placed inside of an external compartment 338, which is then closed by a zipper 339*b*. Since the extended changing mat 336 is permanently attached to the lower edge of the carrying case 300, the extended changing mat 336 cannot be lost. The extended changing mat 336 has a width 336*a* that exceeds the width 339*a* of the external compartment 338 in which the mat is attached. Advantageously, this provides a large surface area which a hunter can use to change.

Figure 21:
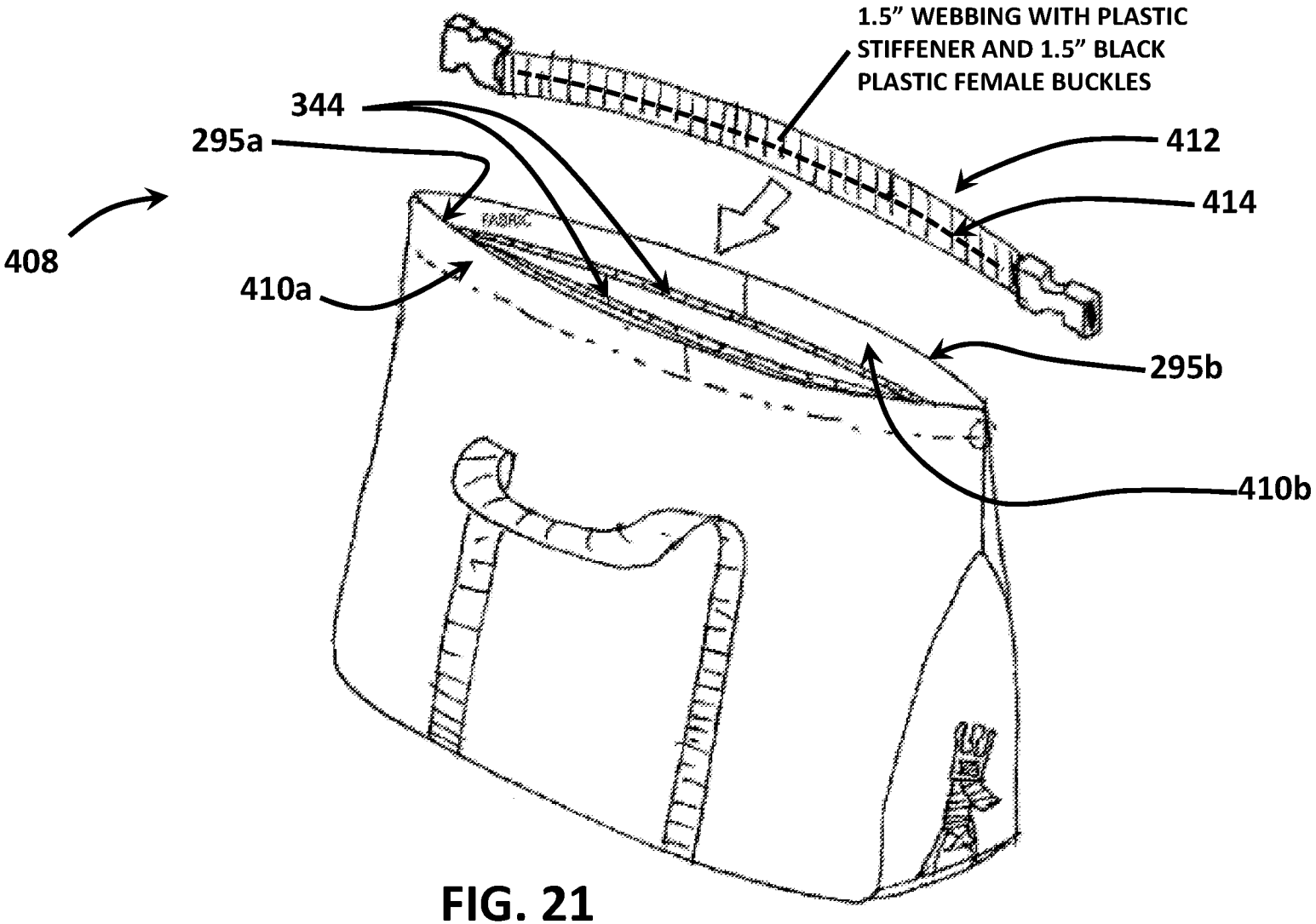
FIG. 21 is an isometric view of an embodiment of a case, illustrating the webbing with stiffener removed from the case.
Figure 22:
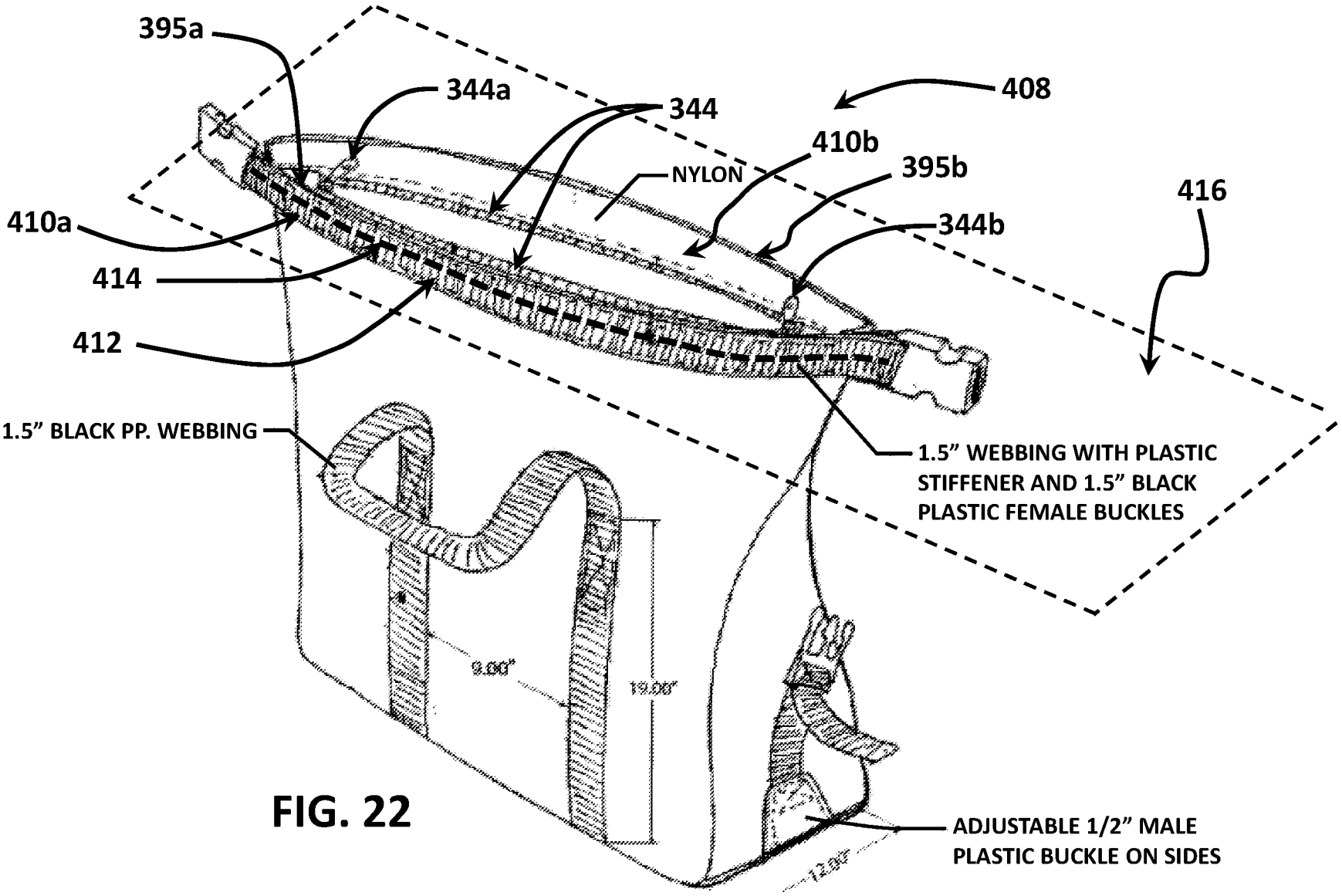
FIG. 22 is an isometric view of an embodiment of the case of FIG. 21, illustrating the zipper strip and the webbing with stiffener attached to the case.

In an embodiment illustrated in FIGS. 21-22, case 408 includes: (a) distal sections 410*a*, 410*b*: (b) zipper 344 connected to both sections 410*a*, 410*b*: and (c) webbing 412 connected to section 410*a*. Webbing 412 includes a stiffener strip or stiffener 414. In this embodiment, zipper 344 has pulls 344*a*, 344*b*. As shown, zipper 344 is inset such that stiffener 414 extends in a plane 416, and the plane 416 is located above the zipper 344 when the case 408 is positioned upright in the unrolled condition.

Figure 23:
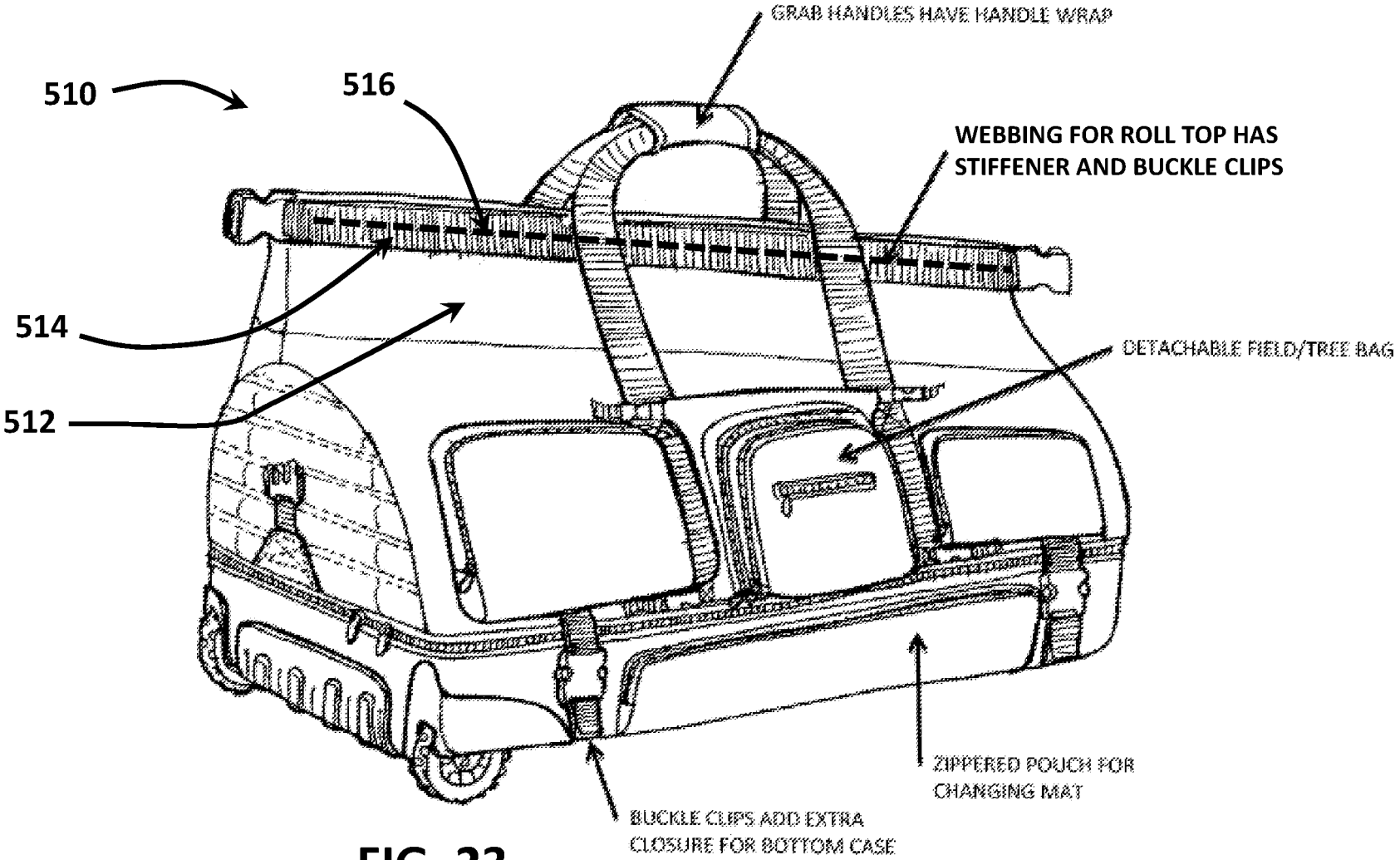
FIG. 23 is an isometric view of an embodiment of a case, illustrating the webbing having a stiffener and buckle clips.

In an embodiment illustrated in FIG. 23, case 510 has a roll top 512 and a webbing 514 connected to the roll top 512. The webbing 514 includes a stiffener 516.

Figure 24:
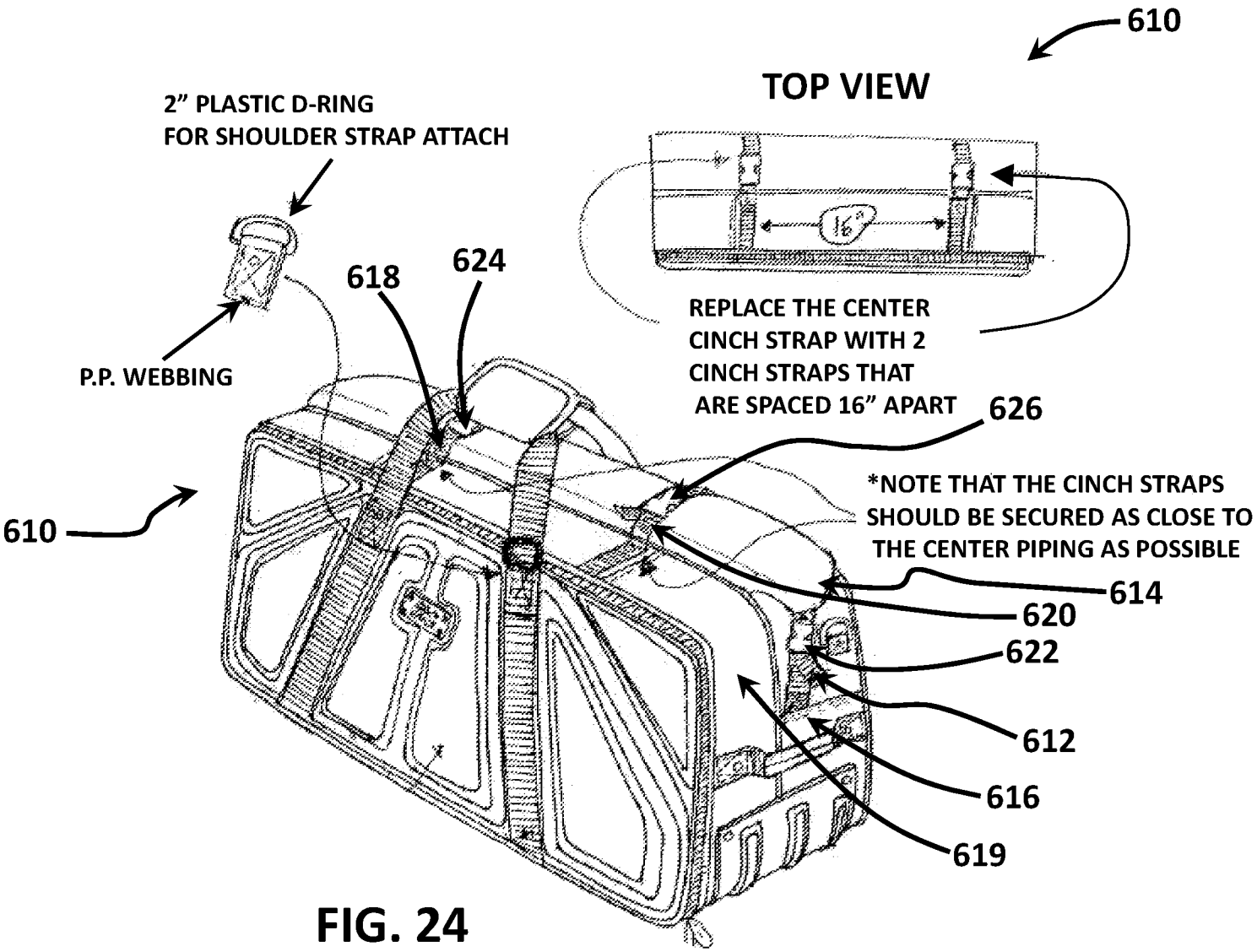
FIG. 24 is an isometric view of an embodiment of a case, illustrating an end strap and a plurality of top straps.

In an embodiment illustrated in FIG. 24, the case 610 includes a plurality of end couplers or end straps, including a left end strap (not shown) and a right end strap 612. As shown, the right end strap 612 secures the upper case portion 614 to the lower case portion 616. Case 610 also has a plurality of top couplers or top straps, including a left top strap 618 and a right top strap 620. As shown, the left top strap 618 secures the upper case portion 614 to the front case portion 619, and the right top strap 620 also secures the upper case portion 614 to the front case portion 619. Each of the straps 612, 618 and 620 include buckles 622, 624, 626, respectively.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A carrying case comprising:

an external shell that defines a storage compartment defining a space, the storage compartment comprising:

an internal extendable bag, permanently joined to the external shell, the internal extendable bag comprising a bottom, wherein the bottom is not affixed to the external shell;

a plurality of first fasteners on opposite ends of the external shell, each first fastener being configured to mate with a corresponding second fastener of a plurality of second fasteners;

a webbing affixed to an exterior of the external shell where (i) a length of the webbing is substantially equal to an opening associated with the space, (ii) the webbing coupled to a plastic stiffener strip with the webbing and the plastic stiffener strip extending in a plane wherein the plane is located at a the top portion of the external shell when the storage compartment is positioned upright before being partially rolled-up, the internal extendable bag and the external shell configured to be rolled-up simultaneously when the webbing and plastic stiffener strip are folded over the top portion of the space at least once;

the plurality of second fasteners where a first of the plurality of second fasteners is affixed to a first end of the webbing and a second of the plurality of second fasteners is affixed to an opposite end of the webbing; and one or more third fasteners, disposed between the plurality of first fasteners and configured to mate with one or more corresponding fourth fasteners in a case that the stiffener strip is folded over the top portion of the space at least once and the storage compartment and the external shell configured are rolled-up simultaneously to secure the rolled-up storage compartment and external shell.

2. A case comprising:

an external shell that defines a storage compartment defining a space, the storage compartment comprising:

an internal bag, the internal bag permanently affixed to the storage compartment; and a webbing affixed to an exterior of the external shell where (i) a length of the webbing is substantially equal to an opening associated with the space, (ii) the webbing coupled to a plastic stiffener strip with the webbing and the plastic stiffener strip extending in a plane wherein the plane is located at a top portion of the external shell when the storage compartment is positioned upright before being partially rolled-up, the internal extendable bag and the external shell configured to be rolled-up simultaneously when the webbing and plastic stiffener strip are folded over the top portion of the space at least once;

a first fastener affixed to a first end of the webbing and a second fastener affixed to an opposite end of the webbing wherein the first fastener is configured to mate with a corresponding third fastener affixed to the external shell and the second fastener is configured to mate with a fourth fastener affixed to the external shell; and one or more fifth fasteners, disposed between the plurality of first fasteners and configured to mate with one or more corresponding sixth fasteners in a case that the stiffener strip is folded over the top portion of the space at least once and the storage compartment and the external shell configured are rolled-up simultaneously to secure the rolled-up storage compartment and external shell.

3. The case of claim 2, wherein the bag comprises a waterproof coating.

4. A carrying case comprising:

an external shell that defines a storage compartment defining a space, the storage compartment comprising:

an internal bag, the internal bag permanently affixed to the storage compartment; and a webbing affixed to an exterior of the external shell where (i) a length of the webbing is substantially equal to an opening associated with the space, (ii) the webbing coupled to a plastic stiffener strip with the webbing and the plastic stiffener strip extending in a plane wherein the plane is located at a top portion of the external shell when the storage compartment is positioned upright before being partially rolled-up, the internal extendable bag and the external shell configured to be rolled-up simultaneously when the webbing and plastic stiffener strip are folded over the top portion of the space at least once;

a first fastener affixed to a first end of the webbing and a second fastener affixed to an opposite end of the webbing wherein the first fastener is configured to mate with a corresponding third fastener affixed to the external shell and the second fastener is configured to mate with a fourth fastener affixed to the external shell; and one or more fifth fasteners, disposed between the plurality of first fasteners and configured to mate with one or more corresponding sixth fasteners in a case that the stiffener strip is folded over the top portion of the space at least once and the storage compartment and the external shell configured are rolled-up simultaneously for securing the rolled-up storage compartment and external shell.

* * * * *